United States Patent [19]

Massie

[11] Patent Number: 4,467,857

[45] Date of Patent: Aug. 28, 1984

[54] CASTING APPARATUS

[76] Inventor: Lewis E. Massie, 2218-13th St., Olivenhain, Calif. 92024

[21] Appl. No.: 428,876

[22] Filed: Sep. 30, 1982

[51] Int. Cl.[3] ..... B22D 18/06

[52] U.S. Cl. ..... 164/253; 164/254

[58] Field of Search ..... 164/253, 254, 255, 61, 164/65

[56] References Cited

U.S. PATENT DOCUMENTS 1,962,456 6/1934 Myers ..... 164/308

3,620,296 11/1971 Barbieri ..... 164/308

*Primary Examiner*—Nicholas P. Godici

*Assistant Examiner*—Jerold L. Johnson

[57] ABSTRACT

A casting apparatus wherein a weighted lever operated plunger has its operational rate regulated by a friction brake. A movable weight on the lever provides a selection of amplified operating force on the plunger. The lever is coupled with the piston of a vacuum pump having a valve to regulate the rate of application of vacuum to the molding flask. Safety linkages coupled to the lever prevent non-scheduled operation of the casting apparatus.

1 Claim, 4 Drawing Figures

CASTING APPARATUS

BACKGROUND OF THE INVENTION

This invention relates to casting processes using investment molds as used in the lost wax casting techniques. The term, lost wax casting, also applies to the use of plastic materials for making patterns.

The basic steps in making an investment casting is the casting of the pattern in a non-wetting, air porous investment material which is contained in a metal flask. The flask containing the pattern in the investment is then baked at temperatures high enough to reduce the pattern to gas and ashes which are expelled through a hole in the top on the flask. While the flask is still at temperature, molten metal is introduced into the hole in the flask.

The casting art is very old having been used thousands of years ago but like any other art it has been subject to continual improvements. For large casting, gravity is sufficient to cause the metal to flow into the mold but for small delicate casting, gravity has been implemented by applying pressure to the molten metal or by using a vacuum to pull the metal into the mold or by a combination of both pressure and vacuum. The increase in costs of precious metals in the jewelry trade has introduced the challenge of finer and smaller castings.

In fine castings the surface-to-volume ratio is high and thus heat is rapidly being extracted from the molten metal through the relatively large surface while it is flowing into the crevices of an intricate casting. Freezing of the molten metal can and does occur before the molten metal has completely filled the mold. Contributing to the freezing of the metal before the mold is completely filled is compounded by the surface tension effect and the remnant air in the mold cavity. Thus heat is rapidly being extracted from the molten metal. The surface tension effect is the tendency for liquid metal droplets to "ball up" when sitting on a non-wetted surface. These problems in investment casting can be solved by maintaining the superheat of the molten metal until the mold cavity is completely filled and pressure and/or vacuum is applied to force the melt into the crevices.

In the present state-of-the-art pressure is applied by a piston, steam, air or the centripetal force of a centrifuge. The most widely used method is the centrifuge, usually energized by a spring motor which accelerates the flask to a rotary speed in the vicinity of 5 to 8 revolutions per second with a maximum pressure in the mold by the metal of 10 to 20 pounds per square inch. The pressure starting at zero then increasing to maximum pressure as the centrifuge accelerates to maximum rotational speed then reducing to zero as the centrifuge coasts to a stop. This pressure is not constant in the mold as the radius to the center of rotation varies as the length of the mold. There is a certain amount of injury risk in the operation of the centrifuge. Problems of pressure control and the rate of application of pressure are similarly inherent in the steam, vacuum or piston systems as observed in the present state-of-the-art.

The following U.S. Patents and/or other prior art disclose such patents.

U.S. Pat. Nos. 1,758,380, 2,369,277, 1,962,456, 2,785,448, 3,123,875, 3,705,615, 3,712,364, 3,903,953, 4,245,690.

SUMMARY OF THE INVENTION

The casting apparatus of the present invention provides for the rapid application of controlled pressure and vacuum to the mold the instant the pouring operation ceases. It is important that the pressure and vacuum are applied at a predetermined rate. A sudden impact of pressure is as detrimental to the quality of the casting as is a too-gradual application. To meet the requirements for small intricate castings with well defined sharp edges higher mold pressures, then the pressures available in conventional systems are needed. These desired objectives, as well as automatic safety of operation, are provided by the present invention.

DESCRIPTION OF THE PREFERRED EMBODIMENTS

Figure 3:
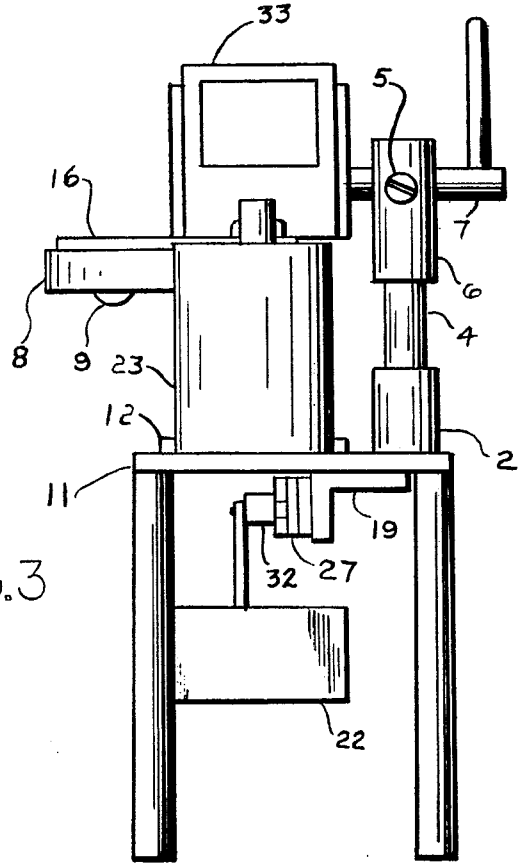
FIG. 3 is a sectional view of a portion of the apparatus shown in FIG. 1
Figure 1:
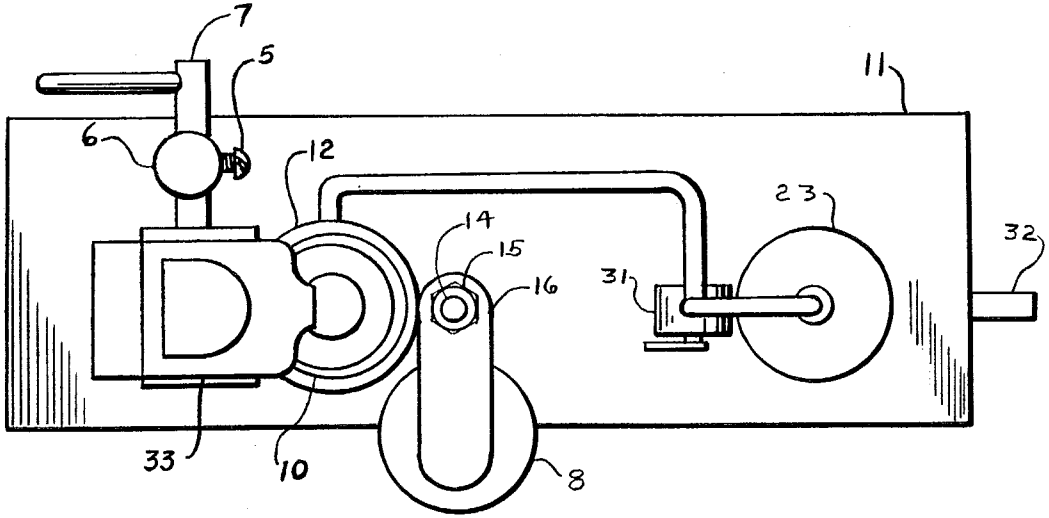
FIG. 1 is a plan view of the casting apparatus
Figure 4:
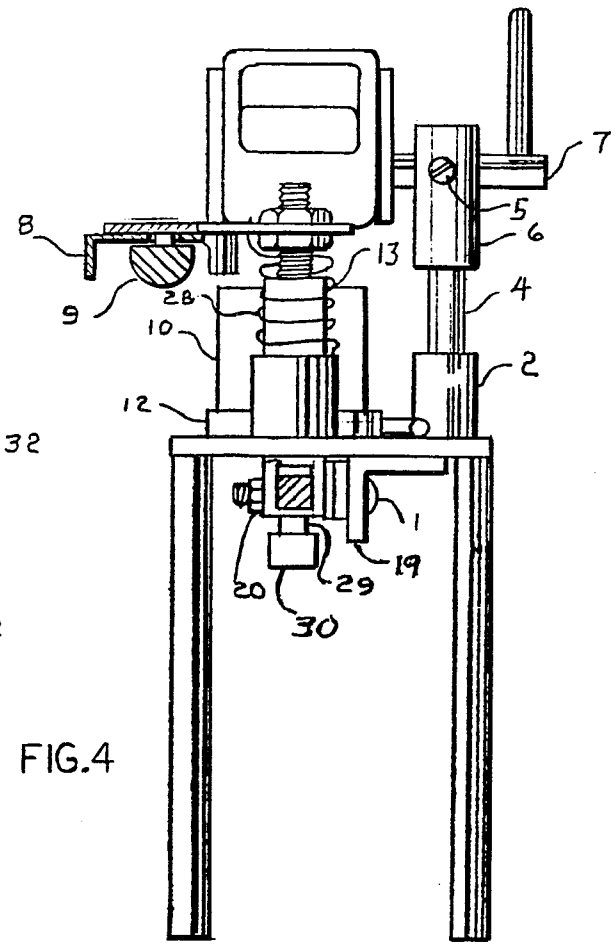
FIG. 4 is a sectional view through 1—1 of FIG. 1
Figure 2:
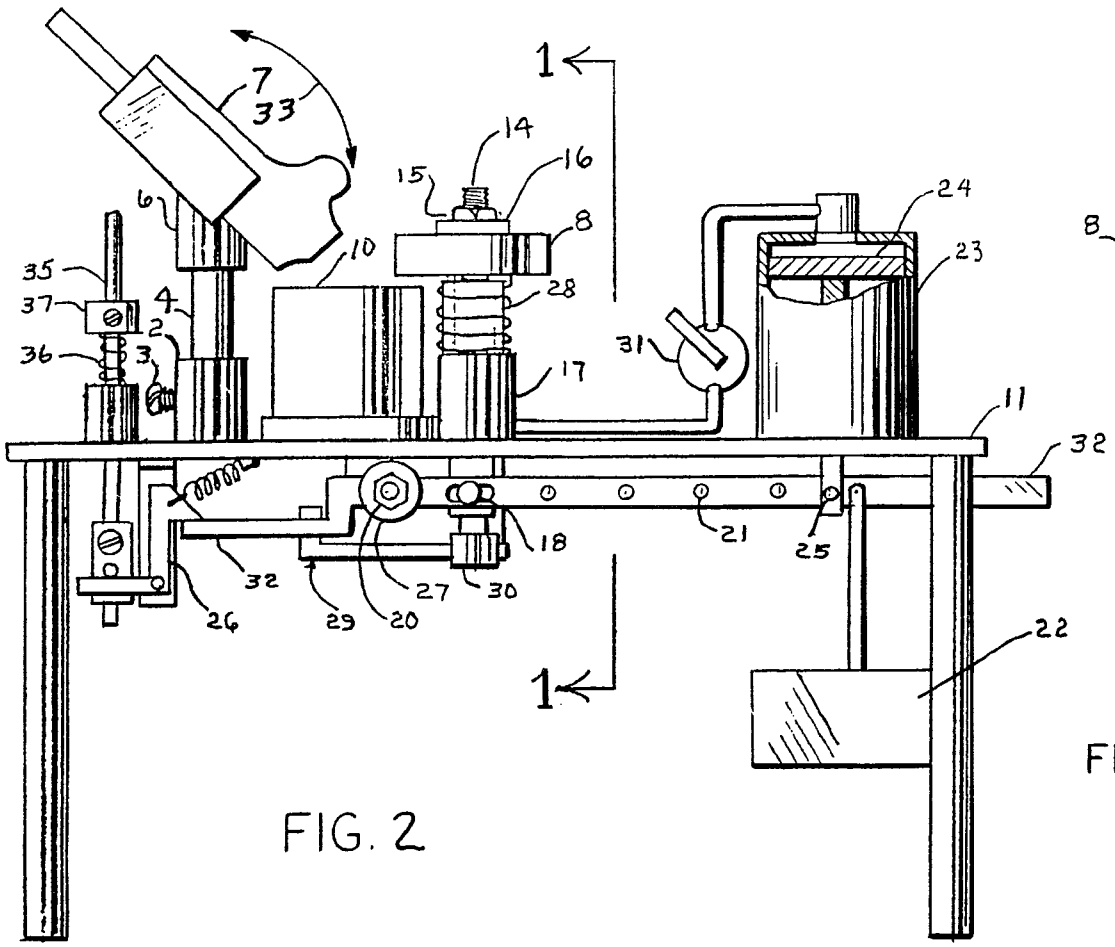
FIG. 2 is a front elevation of the casting apparatus

In the embodiment illustrated in FIGS. 1–4, the casting apparatus comprises an investment molding flask 10, the base structure 11 a flask retaining flange 12 a pressure plunger 9 with shield cup 8, a crucible 33, rotatably-mounted on shaft 7.

The crucible support shaft 7 adjustable in height above the base 11 by means of collar 2 and set screw 3, on the vertical shaft 4. The radius of the crucible to the shaft 4 is slidably adjusted by the set screw 5 in the collar 6.

The pressure plunger 9 together with the shield cup 8 being capable of rotating with the vertical shaft 13 and adjustable in height above the base 11 by means of the threaded segment 14 and the nut 15 on the bar 16, the pressure plunger 9 being flexibly attached to bar 16.

The vertical shaft 13 retained in flanged bearing 17 is coupled to the operating lever 32 by pin 18. The lever 32 being coupled to flange 19, and adjustable friction brake 27 by nut 20. Regularly spaced holes 21 along the lever 32 for attaching weight 22.

A vacuum cylinder 23 with internal plunger 24 is mounted on top of base 11 with the plunger operating shaft coupled to lever 32 by pin 25. The rate of vacuum flow is adjustable by valve 31.

The operating lever 32 is locked in the upward loaded position by latch 26. Latch 26 releasable by the counterclockwise rotation of the crucible support shaft 7 through the linkage 35.

A torsion spring 28 biases the shaft 13 to rotate the shield cup 8 into the proper position above the flask 10 to align the plunger 9 with the top opening in the flask 10. The shaft 13 is restrained from rotating by latch 29 fastened to shaft 13 by collar 30. Upward movement of that portion of lever 32 engaging latch 29, releases latch 29 allowing rotation of shaft 13.

The sequence of operations of the casting apparatus is initiated by adjusting the weight 22 to apply the selected load to shaft 13. The weight is then raised to the loaded position and retained by latch 26. Friction brake 27 is adjusted to regulate the rate of rotation of the operating lever 32 and consequently the rate pressure is applied by plunger 9. The metal to be cast is placed into the crucible 33 and heated to the molten state by a suitable flame. When the metal reaches the proper temperature the crucible is rotated to pour the fluid metal into the flask 10. After pouring, the crucible is rotated counterclockwise to depress linkage shaft 35 to overcome spring 36 positioned by screw collar 37. Downward movement of shaft 35 releases latch 26 allowing lever to rotate clockwise to release latch 29. Releasing latch 29 allows shaft 13 to rotate and depress shield cut 8 and plunger into the opening in the casting flask 10. Simultaneously, the weight 22 acting on lever 32 applies vertically downward loading on the shaft to operate plunger 24 in vacuum pump 23 to apply vacuum to valve 31 and flask 10. Thus, the described casting apparatus, in rapid sequence applies preselected pressure and vacuum to the flask 10. The high leverage long stroke operating lever 32 provides high pressure to the short stroke plunger 9. Operator protection is provided by the shield cup and interlocking linkages.

What is claimed:

1. In a casting apparatus of the type comprising a base, a mold mounted on the base, a pouring mechanism for pouring molten metal into the mold, a pressure system at the top of the mold for applying pressure to force the molten metal into the mold, and a vacuum system at a bottom of the mold for drawing molten metal into the mold, the improvements comprising:

(a) a weighted lever coupled with the pressure system and the vacuum system, said lever being coupled to a pressure plunger of the pressure system and a vacuum pump piston of the vacuum system;

(b) means for positioning the plunger over an opening in the mold;

(c) adjustable means for regulating the rate at which the lever rotates about a pivot point;

(d) means on the lever for positioning weights along the lever;

(e) a rotatable crucible to pour molten metal into the mold;

(f) latching means to lock the lever in an upward loaded position; and (g) linkage means connecting the crucible and the latching means, said linkage means releasing the latching means upon contact with the crucible.

* * * * *